US005664770A

United States Patent [19]

Keller

[11] Patent Number: 5,664,770

[45] Date of Patent: Sep. 9, 1997

[54] APPARATUS FOR DELIVERING PRINTED PRODUCTS TO A FURTHER-PROCESSING LOCATION

[75] Inventor: Alex Keller, Eschenbach, Switzerland

[73] Assignee: Ferag AG, Switzerland

[21] Appl. No.: 686,248

[22] Filed: Jul. 25, 1996

[30] Foreign Application Priority Data

Jul. 25, 1995 [CH] Switzerland ..... 02 183/95-9

[51] Int. Cl.[6] ..... B65H 5/22

[52] U.S. Cl. ..... 271/3.11; 271/151; 271/12

[58] Field of Search ..... 271/3.08, 3.11, 271/149, 150, 151, 11, 12, 272, 100, 186, 216

[56] References Cited

U.S. PATENT DOCUMENTS

| | | | |
|---|---|---|---|
| 3,224,558 | 12/1965 | Carlen . | |
| 3,735,977 | 5/1973 | Reist . | |
| 4,071,234 | 1/1978 | Schick . | |
| 4,127,262 | 11/1978 | Eberle et al. . | |
| 4,279,412 | 7/1981 | Glatz . | |
| 4,320,894 | 3/1982 | Reist et al. . | |
| 4,350,330 | 9/1982 | Brown . | |
| 4,768,770 | 9/1988 | Pessina et al. | 271/150 |
| 4,869,486 | 9/1989 | Scatpa et al. | 271/150 |
| 5,042,792 | 8/1991 | Honegger et al. . | |
| 5,356,129 | 10/1994 | Godlewski | 271/151 |
| 5,377,967 | 1/1995 | Eberle . | |
| 5,398,920 | 3/1995 | Leu . | |
| 5,542,656 | 8/1996 | Stauber . | |

FOREIGN PATENT DOCUMENTS

| | | | |
|---|---|---|---|
| 240266 | 5/1965 | Australia . | |
| 000574346A2 | 12/1993 | European Pat. Off. | 271/11 |
| 401933 | 9/1924 | Germany . | |

*Primary Examiner*—H. Grant Skaggs
*Attorney, Agent, or Firm*—Brinks, Hofer Gilson & Lione

[57] ABSTRACT

Folded printed products are conveyed in a first imbricated formation up to a stop by a first conveying device. In the first imbricated formation each printed product rests on the following printed product with its leading bottom edge formed by its folded edge. At the stacking location formed by the stop, the printed products are stacked up in layers to form an intermediate stack. The uppermost printed product is moved by a lifting member into the conveying region of a removal conveyor and then to a further-processing station. The removal conveyor has a conveying wheel that is driven synchronously with the lifting member, and a pressing-on member that, as a strand of a belt conveyor, is assigned to a part of the circumferential surface of the conveying wheel. The conveying wheel and the pressing-on member together form a guidance gap for the printed products. The conveying wheel is provided with a plurality of cutouts that are distributed uniformly on the circumferential surface. The folded edges of the printed products are introduced individually into the cutouts by the lifting member. The printed products are then directed into the guidance gap by virtue of the rotation of the conveying wheel. A second imbricated formation is formed, in which, once again, each printed product rests on the following printed product and the leading folded edge is located at the bottom.

9 Claims, 2 Drawing Sheets

APPARATUS FOR DELIVERING PRINTED PRODUCTS TO A FURTHER-PROCESSING LOCATION

BACKGROUND OF THE INVENTION

The present invention relates to an apparatus for delivering printed products to a further-processing location.

An apparatus of this type is known from U.S. Pat. No. 5,398,920 and the corresponding EP-A 0 551 601. In this apparatus, the uppermost printed product is lifted, in the region of its folded edge, from the intermediate stack by a lifting member. The uppermost printed product is then pushed back in a direction counter to the feed direction of the first conveying device. The open edge of the printed products is directed, with the aid of an additional directing member, into the guidance gap of the removal conveyor that is formed by two belt conveyors arranged one above the other. In this arrangement, the spacing of the imbricated formation is determined by the movement of the lifting member, and the conveying speed is defined by the circumferential speed of one of the belt conveyors.

In this apparatus, a new imbricated formation is formed, in which each printed product rests on the following printed product and the leading bottom edge is formed by the open side edge.

Accordingly, the object of the present invention is to provide a straightforward apparatus for delivering printed products that makes it possible to form a new imbricated formation in which each printed product rests on the following printed product and the leading bottom edge of the printed product is formed by the folded edge.

SUMMARY OF THE INVENTION

The present invention provides an apparatus for delivering printed products to a further-processing location comprising a first conveying device, a removal conveyor, and a lifting member. The first conveying device feeds printed products in a first imbricated formation to a stacking location having an intermediate stack of printed products that is charged from beneath. The first imbricated formation includes printed products that rest on a following printed product.

The removal conveyor has a conveying region, a conveying member, and a pressing-on member. The conveying member and the pressing-on member together form a guidance gap for the printed products. The conveying member has a conveying wheel that has a circumferential surface and a plurality of cutouts for directing printed products into the guidance gap. The cutouts are distributed uniformly on the circumferential surface. The pressing-on member has a belt conveyor with a strand assigned to a part of the circumferential surface of the conveying wheel.

The lifting member lifts an uppermost printed product from the intermediate stack, and delivers the uppermost printed product into the conveying region of the removal conveyor and into the cutouts of the conveying wheel. The lifting member is driven synchronously with the conveying wheel.

DETAILED DESCRIPTION

Figure 1:
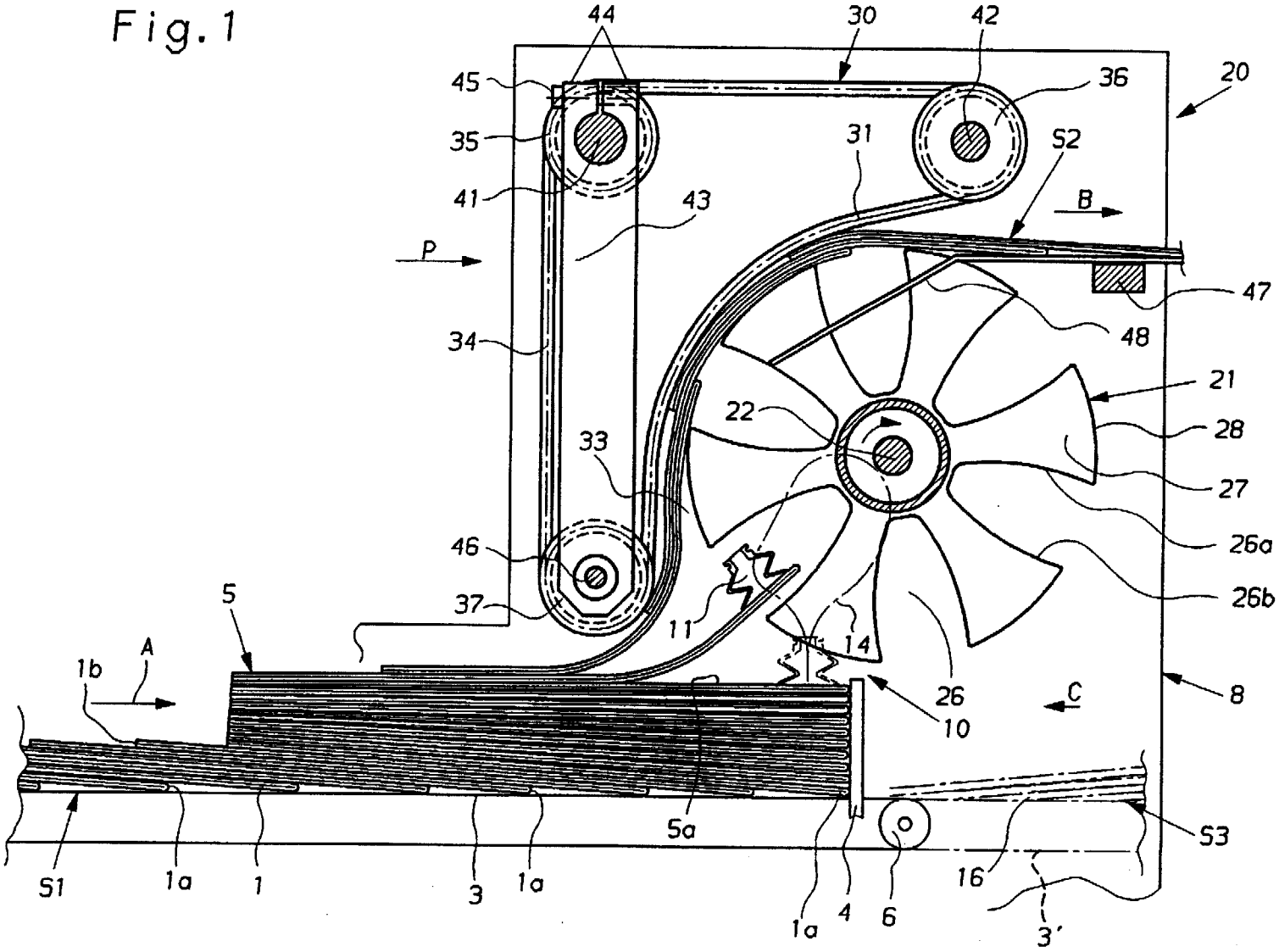
FIG. 1 shows a side view, partly in section, of a schematic representation of an apparatus according to the present invention.

In FIG. 1, folded printed products 1 are arranged in an imbricated formation S1, with each printed product 1 resting on the following printed product. The printed products 1 are conveyed in arrow direction A up to a stop 4 by a first conveying device 3. In this arrangement, the leading bottom edge of the respective printed product 1 is formed by a folded edge 1*a*. Accordingly, the trailing edge of the respective printed product 1 that is located on top of the following printed product, is formed by an open side edge 1*b* located opposite the folded edge 1*a*.

The conveying device 3 is designed as a belt conveyor which may have one or more parallel conveying belts that are guided in circulation around two deflection rollers. Only the front deflection roller of the conveying device 3 is represented in FIG. 1, and designated by reference numeral 6.

Once they have reached the stop 4, the printed products 1 are stacked up in layers to form an intermediate stack 5. Arranged in the region of the intermediate stack 5, beneath the conveying belts, is a rest (not shown) that prevents the conveying belts from sagging under the weight of the intermediate stack 5. The conveying belt 3, or the rest for the intermediate stack 5, is preferably designed to be adjustable in height. In addition, a level-monitoring device, which is well known in the art but is not shown in the drawings, ensures that the upper side 5*a* of the intermediate stack 5 is always located at the desired constant level.

Figure 2:
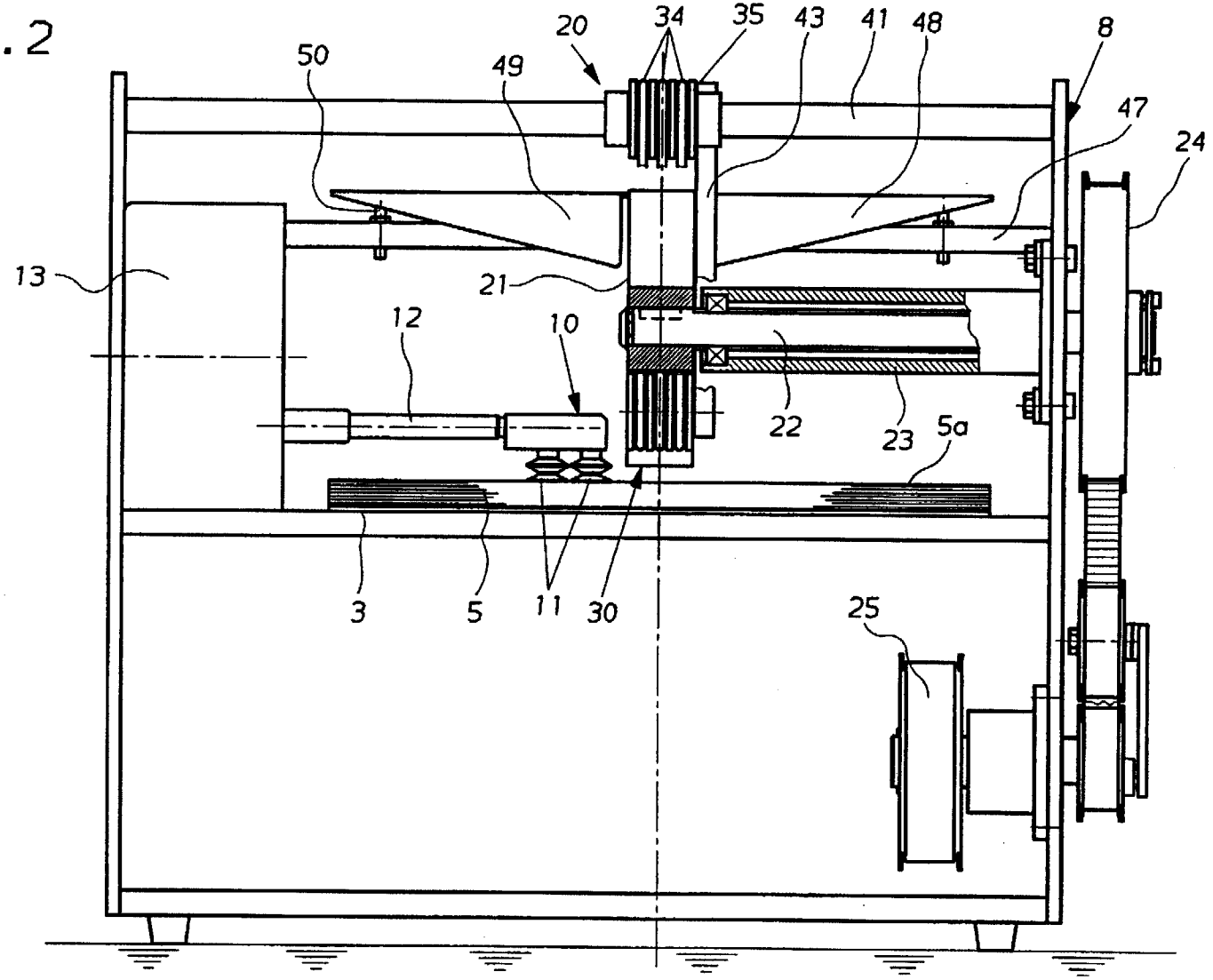
FIG. 2 shows a front view, partly in section, of the apparatus of FIG. 1, as seen in the direction of the arrow P in FIG. 1.

The upper side 5*a* of the intermediate stack 5 is assigned, in the region of the folded edge 1*a*, a lifting member 10 that is provided with at least one suction head 11. Preferably, two suction heads 11 are operatively connected to a negative-pressure source (not shown), and periodically activated and deactivated. The suction heads 11 are provided on a carrying arm 12 that can be connected to a drive and control device 13, as shown in FIG. 2. The drive and control device 13 periodically moves the lifting member 10, or the carrying arm 12 with the suction heads 11. The circulatory path of the lifting member 10 is indicated by chain-dotted lines in FIG. 1 and is designated by reference numeral 14. The drive and control device 13 is well known in the art (see, for example, U.S. Pat. No. 5,377,967 and the corresponding EP-A 0 553 455, or U.S. patent application Ser. No. 08/243,752, now abandoned and corresponding EP-A 0 628 505), and is not described in any more detail.

The lifting member 10 lifts the uppermost printed product 1 from the intermediate stack 5 and moves the printed product 1 into the conveying region of a removal conveyor 20. In the removal conveyor 20, the printed products 1 are arranged in a new imbricated formation S2 and are guided in arrow direction B to a further-processing location (not shown), for example a gripper conveyor. The removal conveyor 22 is described in more detail below.

The removal conveyor 20 has a star-like conveying wheel 21 that is fastened on a horizontal shaft 22 which is rotatably mounted in a housing 23. The housing 23 is screwed on an apparatus framework 8. The shaft 22 is operatively connected to a drive 25 by a gear mechanism 24. The circumferential speed of the shaft 22 and of the conveying wheel 21 can be set. The direction of rotation of the conveying wheel 21 is designated in FIG. 1 by arrow D.

The conveyor wheel 21 is provided with a plurality of cutouts 26 and corresponding wheel segments 27. Preferably, there are six cutouts 26. The wheel segments 27 have concave side surfaces 26*a*, 26*b* and the contour of the cutouts 26 is reminiscent of toothing. The circumferential surface of the conveying wheel 21 or of the wheel segments 27 is designated by reference numeral 28.

The removal conveyor 20 further has a pressing-on member 30 that is assigned to the conveying wheel 21 and is designed as a belt conveyor. One strand 31 of the pressing-on member 30 is assigned to a part of the circumferential surface 28 of the conveying wheel 21 and, together with this part, forms a guidance gap 33 for the printed products 1. The pressing-on member 30 is designed as a belt conveyor and is equipped with a plurality of parallel pressing-on belts 34 that are guided continuously in circulation around three deflection rollers 35, 36, 37. Two of the deflection rollers 35, 36 are mounted in a freely rotatable manner on horizontal spindles 41, 42, respectively. The spindles 41, 42 are arranged in a stationary manner in the upper region of the apparatus framework 8, and are arranged parallel to one another and to the shaft 22. Fastened on the spindle 41 by a clamping screw 45 is a retainer 43 that is provided with two clamping jaws 44. The retainer 43 projects downward into the vicinity of the intermediate stack 5 and is provided with a carrying bolt 46 for the third lower deflection roller 37. The deflection roller 37 is likewise mounted in a freely rotatable manner on the carrying bolt 46. The above-mentioned strand 31 that is assigned to the driven conveying wheel 21, binds the guidance gap 33, and belongs to the pressing-on member 30, extends between the deflection rollers 37 and 36. Adjusting or pivoting the retainer, arranged essentially tangentially with respect to the conveying wheel 21, around the spindle 41 allows the conveying gap 33 formed by the active strand 31 and the conveying wheel 21 (in particular, the inlet of the conveying gap), to be set and fixed by the clamping screw 45. The setting of the retainer 43, and thus the conveying gap 33, depends upon the thickness of the printed products 1 that are to be processed.

Installed in the apparatus framework 8, parallel to the shaft 22 and to the spindles 41, 42, is a crossmember 47. A support and guidance plate 48, 49 is adjustably mounted, on both sides of the conveying wheel 21, to the crossmember 47 by screws 50 (as shown in FIG. 2). With the aid of the support and guidance plates 48, 49, the printed products 1 are guided over their width and are prevented from tilting laterally.

The mode of operation of the above-described apparatus will now be described below, insofar as it has not already been made clear from the above embodiments.

The printed products 1 fed by the first conveying device 3 in the first imbricated formation S1 are pushed into the intermediate stack 5 with the folded edge 1*a* at the bottom. The respectively uppermost printed product 1 of the intermediate stack 5 is gripped, in the region of the folded edge 1*a*, by the suction heads 11 that are connected to the negative-pressure source of the lifting member 10. The printed product 1 is then introduced into a cutout 26 that is located momentarily above the folded edge 1*a*. The cutout 26 is a part of the conveying wheel 21 that is driven in the direction of rotation D. As soon as the lifted printed product 1 has been taken along by the side surface 26*a* of the relevant cutout 26 of the conveying wheel 21, and has been directed to the guidance gap 33, the lifting member 10 is disconnected from the negative-pressure source. The lifting member 10 then returns back along the circulatory path 14 into its initial position, moving the printed product 1 away from its path in the process. In its initial position, the lifting member 10 is able to grip the next printed product 1 and introduce the latter into the next cutout 26. Meanwhile, the printed product 1 is displaced out of the cutout 26 and into the guidance gap 33 between the circumferential surface 28 of the wheel segment 27 preceding the cutout 26 (with respect to the direction of rotation D) and the preceding printed product 1. The printed product 1 then commences its transportation. Each printed product 1 is thus introduced one after the other into one of the cutouts 26, the lifting member 10 being driven synchronously with the conveying-wheel drive. In this manner, the new imbricated formation S2 of the printed products 1 is formed in which, once again, each printed product 1 rests on the following printed product and the leading folded edge la is located at the bottom. In this arrangement, the conveying speed of the printed products 1 that are to be removed is determined by the circumferential speed of the conveying wheel 21 of the removal conveyor 20. In addition, the spacing of the imbricated formation is defined by the conveying wheel 21 and determined by the spacing of the wheel segments 27 (measured on the circumference of the conveying wheel 21). Therefore, in the apparatus of the present invention, both the conveying speed of the removal conveyor and the spacing of the imbricated formation are advantageously determined by one member, namely the conveying wheel.

The form of the cutouts 26 allows the printed products 1 to be directed into the guidance gap 33 without being subjected to bending or any other type of deformation. While in the first imbricated formation S1 it was possible for irregularities in the spacing of the imbricated formation to occur and for printed products 1 to be missing, the apparatus according to the present invention forms a new, precisely defined imbricated formation S2 that has no irregularities.

The printed products 1 leaving the removal conveyor in direction B are gripped in a manner that is not shown and guided away, even before the trailing edge 1*b* leaves the guidance gap 33. The support and guidance plates 48, 49 engage beneath that part of the printed products 1 which is leaving the guidance gap 33.

As is indicated by chain-dotted lines in FIG. 1, an imbricated formation S3, in which each printed product 1 likewise rests on the following printed product, but the leading bottom edge is formed by the open side edge 1*b*, could also be conveyed by the present invention to a further-processing location. In this case, however, the stop 4 would have to be offset to the left (as seen in FIG. 1) in order for the printed products 1, fed in arrow direction C by a conveying device 3', to be located, once again, with their folded edge (trailing this time) beneath the lifting member 10 in the intermediate stack 5. The further procedure or removal of the printed products 1 in the new imbricated formation S2 to the further-processing location would take place in the same manner as described above.

The present invention has been illustrated and described with respect to the preferred embodiments of the invention. It is understood that the invention is not limited thereto, but may be otherwise variously embodied and practiced within the scope of the following claims including all equivalents.

I claim:

1. An apparatus for delivering printed products to a further-processing location comprising:

a first conveying device for feeding printed products in a first imbricated formation to a stacking location, the stacking location having an intermediate stack of printed products that is charged from beneath, the first imbricated formation including printed products that rest on a following printed product;

a removal conveyor having a conveying region, a conveying member, and a pressing-on member, the conveying member and the pressing-on member together forming a guidance gap for the printed products, the conveying member having a conveying wheel, the conveying wheel having a circumferential surface and a plurality of cutouts for directing printed products into the guidance gap, the cutouts distributed uniformly on the circumferential surface, the pressing-on member having a belt conveyor with a strand assigned to a part of the circumferential surface of the conveying wheel; and a lifting member for lifting an uppermost printed product from the intermediate stack and for delivering the uppermost printed product into the conveying region of the removal conveyor and into the cutouts of the conveying wheel, the lifting member being driven synchronously with the conveying wheel.

2. The apparatus of claim 1 wherein the lifting member is assigned to a folded end of the printed products arranged in the intermediate stack.

3. The apparatus of claim 2 wherein the conveying wheel further comprises a star-like cross-section and wheel segments, the wheel segments having concave side surfaces formed by the cutouts.

4. The apparatus of claim 3 wherein the conveying wheel has a circumferential speed, the removal conveyor has a conveying speed that is defined by the circumferential speed of the conveying wheel, and the removal conveyor forms a second imbricated formation of printed products, the second imbricated formation including printed products that rest on a following printed product and that have a leading folded edge located at the bottom, the spacing of the printed products in the second imbricated formation being defined by the spacing of the wheel segments measured on the circumferential surface of the conveying wheel.

5. The apparatus of claim 2 wherein the conveying wheel further comprises wheel segments and a circumferential speed, the removal conveyor has a conveying speed that is defined by the circumferential speed of the conveying wheel, and the removal conveyor forms a second imbricated formation of printed products, the second imbricated formation including printed products that rest on a following printed product and that have a leading folded edge located at the bottom, the spacing of the printed products in the second imbricated formation being defined by the spacing of the wheel segments measured on the circumferential surface of the conveying wheel.

6. The apparatus of claim 1 wherein the conveying wheel further comprises a star-like cross-section and wheel segments, the wheel segments having concave side surfaces formed by the cutouts.

7. The apparatus of claim 6 wherein the conveying wheel has a circumferential speed, the removal conveyor has a conveying speed that is defined by the circumferential speed of the conveying wheel, and the removal conveyor forms a second imbricated formation of printed products, the second imbricated formation including printed products that rest on a following printed product and that have a leading folded edge located at the bottom, the spacing of the printed products in the second imbricated formation being defined by the spacing of the wheel segments measured on the circumferential surface of the conveying wheel.

8. The apparatus of claim 1 wherein the conveying wheel further comprises wheel segments and a circumferential speed, the removal conveyor has a conveying speed that is defined by the circumferential speed of the conveying wheel, and the removal conveyor forms a second imbricated formation of printed products, the second imbricated formation including printed products that rest on a following printed product and that have a leading folded edge located at the bottom, the spacing of the printed products in the second imbricated formation being defined by the spacing of the wheel segments measured on the circumferential surface of the conveying wheel.

9. An apparatus for delivering printed products to a further-processing location comprising:

a first conveying device for feeding printed products in a first imbricated formation to a stacking location, the stacking location having an intermediate stack of printed products that is charged from beneath, the first imbricated formation including printed products that rest on a following printed product;

a removal conveyor having a conveying region, a conveying member, and a pressing-on member, the conveying member and the pressing-on member together forming a guidance gap for the printed products, the conveying member having a conveying wheel, the conveying wheel having a circumferential surface and a plurality of cutouts for directing printed products into the guidance gap, the pressing-on member having a belt conveyor with a strand assigned to a part of the circumferential surface of the conveying wheel; and a lifting member for lifting an uppermost printed product from the intermediate stack and for delivering the uppermost printed product into the conveying region of the removal conveyor and into the cutouts of the conveying wheel, the lifting member being driven synchronously with the conveying wheel.

* * * * *

UNITED STATES PATENT AND TRADEMARK OFFICE

CERTIFICATE OF CORRECTION

PATENT NO. : 5,664,770
DATED : September 9, 1997
INVENTOR(S) : Alex Keller

It is certified that error appears in the above-identified patent and that said Letters Patent is hereby corrected as shown below:

Title page,
Under "FOREIGN PATENT DOCUMENTS " change "Australia" to -- Austria --;

Column 5, claim 3,
Line 19, change "2" to -- 1 --.

Signed and Sealed this

Twelfth Day of February, 2002

*Attest:*

*Attesting Officer*

JAMES E. ROGAN
*Director of the United States Patent and Trademark Office*